US005144987A

United States Patent [19]

Burer et al.

[11] Patent Number: 5,144,987

[45] Date of Patent: Sep. 8, 1992

[54] WEFT DRAWING-IN DEVICE INCLUDING SLOTTED TUBULAR GUIDE MEMBERS

[75] Inventors: Franz Burer, Kollbrunn; Hans-Jorg Gehrig, Henggart; Josef Kaufmann, Elsau; Heinz Maurer, Ettenhausen; Hanspeter Muller, Dorf, all of Switzerland

[73] Assignee: Sulzer Brothers Limited, Winterthur, Switzerland

[21] Appl. No.: 598,688

[22] PCT Filed: Mar. 2, 1990

[86] PCT No.: PCT/CH90/00052

§ 371 Date: Oct. 17, 1990

§ 102(e) Date: Oct. 17, 1990

[87] PCT Pub. No.: WO90/11397

PCT Pub. Date: Oct. 4, 1990

[30] Foreign Application Priority Data

Mar. 17, 1989 [CH] Switzerland ..... 1007/89

[51] Int. Cl.[5] ..... D03D 47/34

[52] U.S. Cl. ..... 139/450; 139/435.1; 139/435.4; 139/194; 226/97

[58] Field of Search ..... 139/435.1, 450, 452, 139/439, 194, 435.4, 435.6; 242/147 A; 226/97

[56] References Cited

U.S. PATENT DOCUMENTS

| | | | |
|---|---|---|---|
| 2,925,833 | 2/1960 | Strake | 139/435.4 |
| 4,197,882 | 4/1980 | Ohnishi . | |
| 4,366,845 | 1/1983 | Simson | 139/435.1 |
| 4,637,229 | 1/1987 | Taylor, Jr. | 139/450 X |
| 4,730,645 | 3/1988 | Baird et al. | 139/435.1 |
| 4,756,341 | 7/1988 | Takehana | 139/435.1 |
| 4,838,321 | 6/1989 | Ishido et al. | 139/435.1 |
| 4,926,911 | 3/1990 | Shaw | 139/450 X |

FOREIGN PATENT DOCUMENTS

| | | |
|---|---|---|
| 0155432 | 9/1985 | European Pat. Off. . |
| 0161376 | 11/1985 | European Pat. Off. . |
| 0171057 | 2/1986 | European Pat. Off. . |
| 0189731 | 8/1986 | European Pat. Off. . |
| 0297040 | 12/1988 | European Pat. Off. . |
| U8712946 | 12/1987 | Fed. Rep. of Germany . |
| 0296975 | 5/1965 | Netherlands . |

*Primary Examiner*—Andrew M. Falik
*Attorney, Agent, or Firm*—Kenyon & Kenyon

[57] ABSTRACT

In a device for a drawing a weft yarn (2) into a loom a continuous guide duct combined from tubular members (54, 55) is interrupted at places so that various operating elements such as a yarn brake (62) or a yarn tensioner (72) can act on the weft yarn (2). The weft yarn (2) is in these cases deflected transversely to the direction of movement through the tubular members, and so the tubular members (54, 55) are formed near the deflection station with slots extending from one deflecting station (63) to the other (63'). The device enables the weft yarn to be drawn in automatically by means of compressed air.

17 Claims, 7 Drawing Sheets

WEFT DRAWING-IN DEVICE INCLUDING SLOTTED TUBULAR GUIDE MEMBERS

The invention relates to a device for drawing a weft yarn into a loom.

In most looms, the weft yarn is guided in a device for drawing-in the weft yarn at least in parts in a duct as, for instance, inside a weft accumulator having a stationary drum on which turns of weft yarn are deposited in the zone between the entry eye and the winding zone on the drum.

In air jet looms, the weft yarn is drawn into the loom at least in parts by means of compressed air while in gripper looms weft yarn is conventionally drawn in manually from the feed bobbin as far as a picking element, to some extent with the use of mechanical means.

Accordingly, it is an object of the invention to simplify the drawing-in of a weft yarn in a loom.

It is another object of the invention to provide a facility for automatically drawing in a weft yarn in a loom.

Briefly, the invention provides a device for drawing a weft yarn into a loom which includes at least one pair of tubular members disposed in coaxially spaced relation for guiding an air-entrained weft yarn therethrough with each tubular member having a longitudinally extending slot to permit lateral deflection of a weft yarn from a respective member. In addition, the device includes means for deflecting a weft yarn laterally from the tubular members.

In one embodiment, the deflecting means is in the form of a yarn brake having a braking plate spaced laterally of the tubular members and a braking finger for deflecting a weft yarn from the tubular members and being movable between a position spaced from the plate and a position engaging the plate.

In another embodiment, the means for deflecting the yarn may be in the form of a yarn tensioner which is movable between a position axially aligned with the tubular members to receive a yarn and a position spaced laterally of the tubular members to deflect the yarn from the tubular members.

The device may also include a pair of yarn deflecting stations each of which has a respective tubular member extending therefrom and which are spaced apart for deflection of a weft yarn between the stations. Also, means for supplying compressed air to each station may be provided for conveying a weft yarn therethrough.

The effect of the device is that a weft yarn can be drawn off a supply bobbin rapidly and guided without any manually guided tool for presentation to a picking element of a loom.

These and other objects and advantages of the invention will become more apparent from the following detailed description taken in conjunction with the accompanying drawings wherein:

FIG. 1 is a perspective overview of part of the device for drawing weft yarns into a loom for four weft colors from the supply bobbin to the yarn brake;

FIG. 1*a* shows a continuation of the device from the weft yarn stop motion immediately after the yarn brake as far as the weft guide duct or tunnel in the loom;

Figure 12:
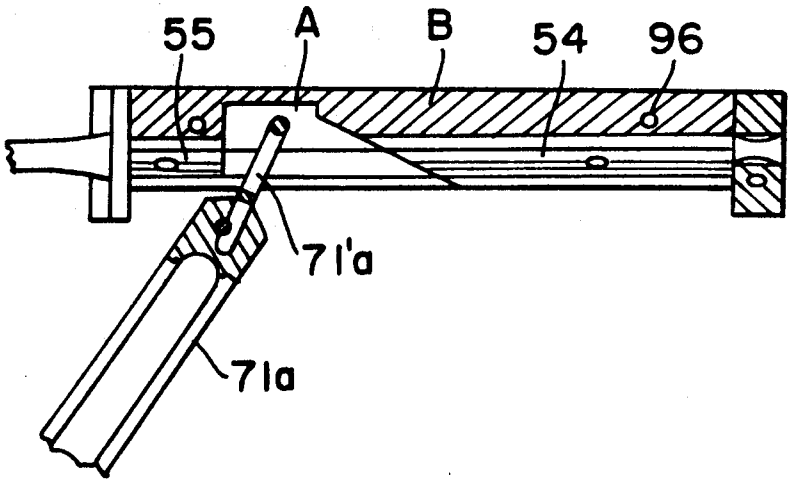
FIG. 12 illustrates a cross sectional view of a modified device employing pairs of tubular members in cooperation with a yarn tensioner.
Figure 12B:
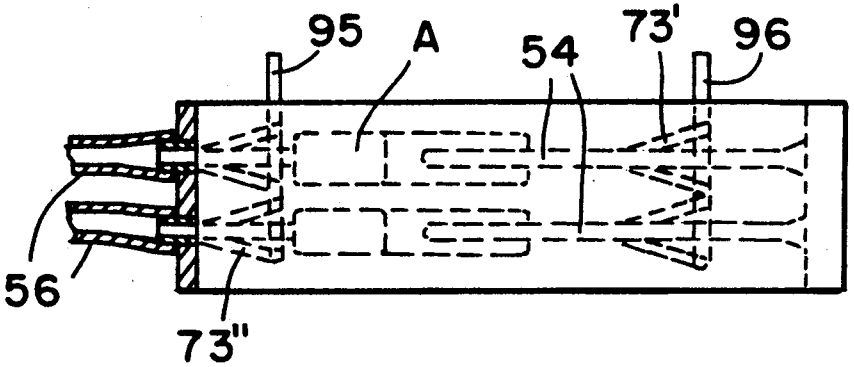
Figure 12C:
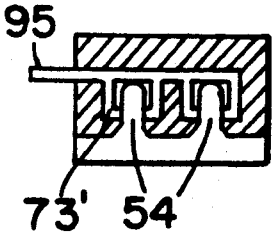
Figure 13A:
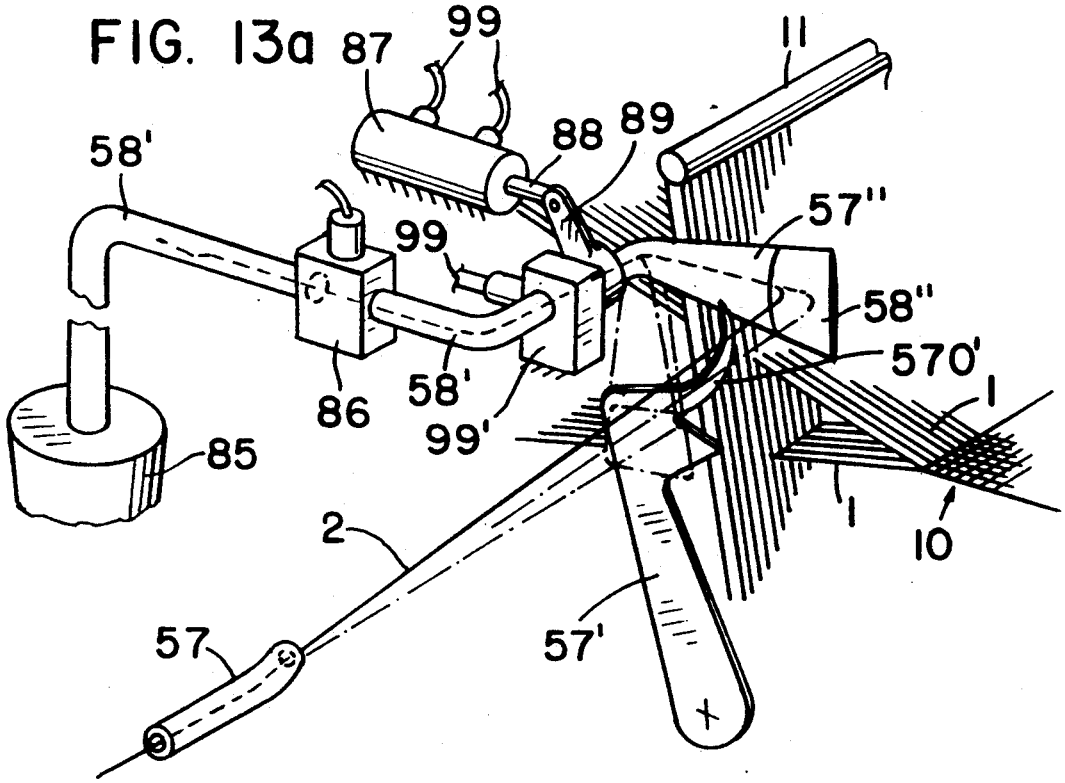
Figure 13B:
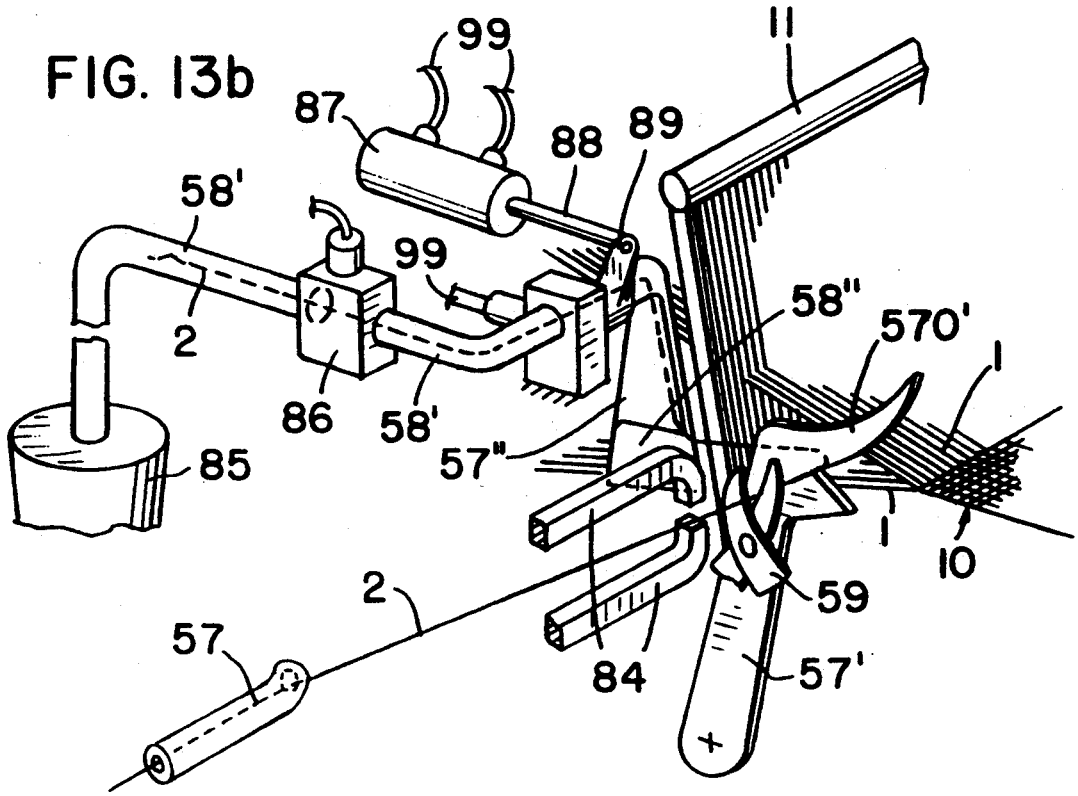

FIG. 12*b* illustrates a part cross sectional plan view of the block of FIG. 12;

FIG. 12*c* illustrates a cross sectional view of the block of FIG. 12;

FIG. 13*a* illustrates a perspective view of a modified yarn-guiding element adjacent to a shed in accordance with the invention; and FIG. 13*b* illustrates a view of the yarn-guiding element of FIG. 13*a* in a deflected position in accordance with the invention.

Figure 1:
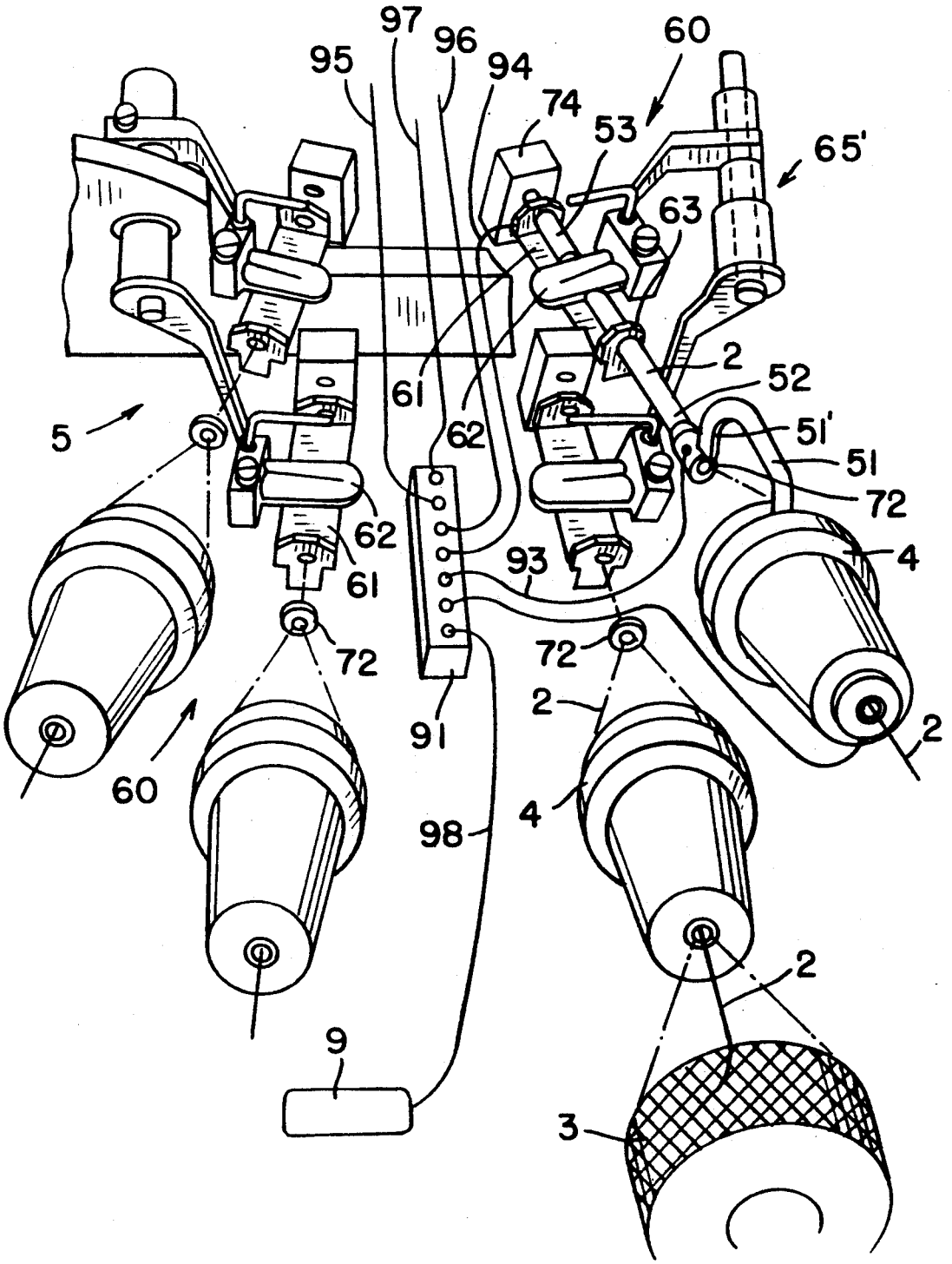
Figure 1A:
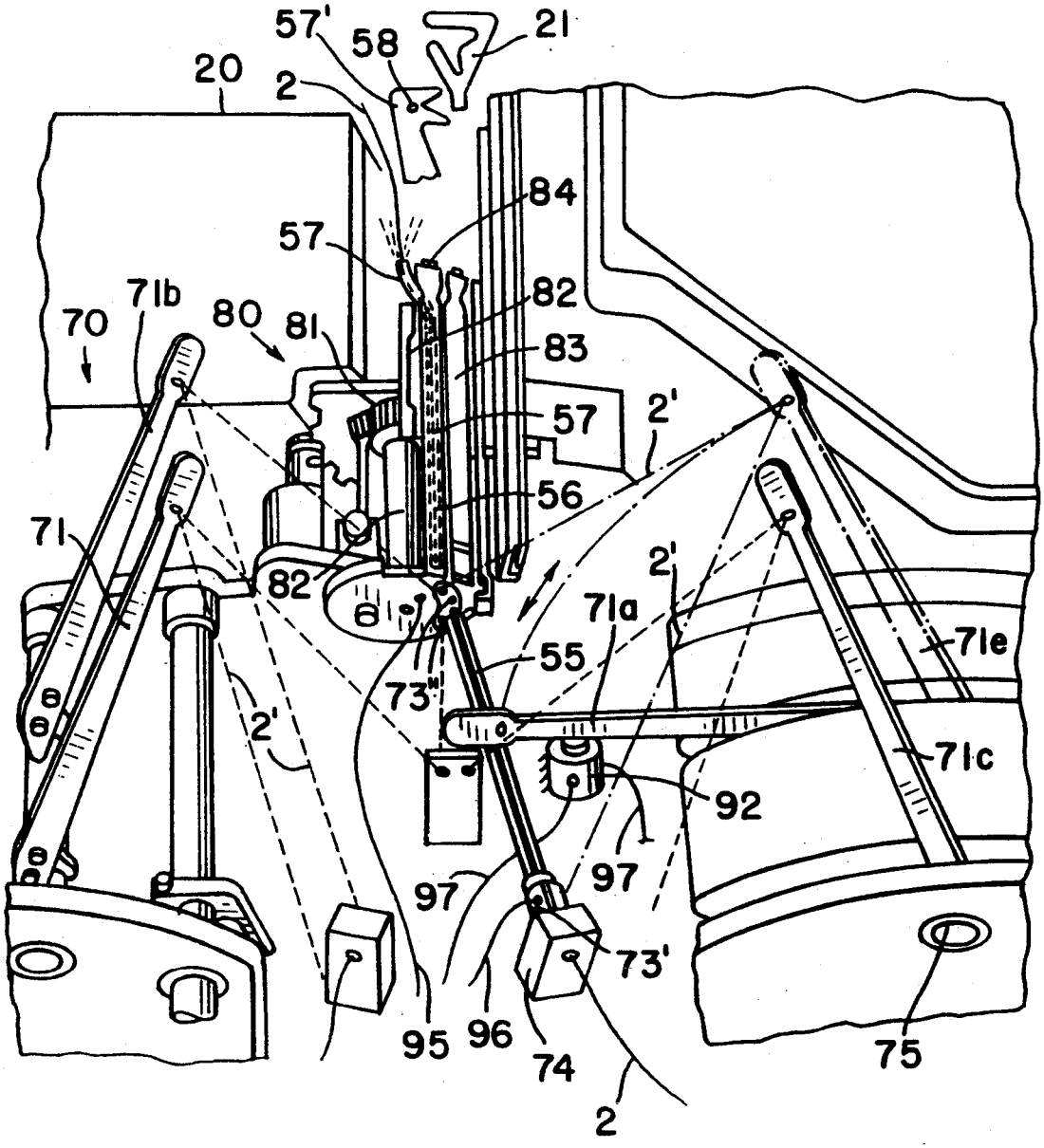
Figure 2:
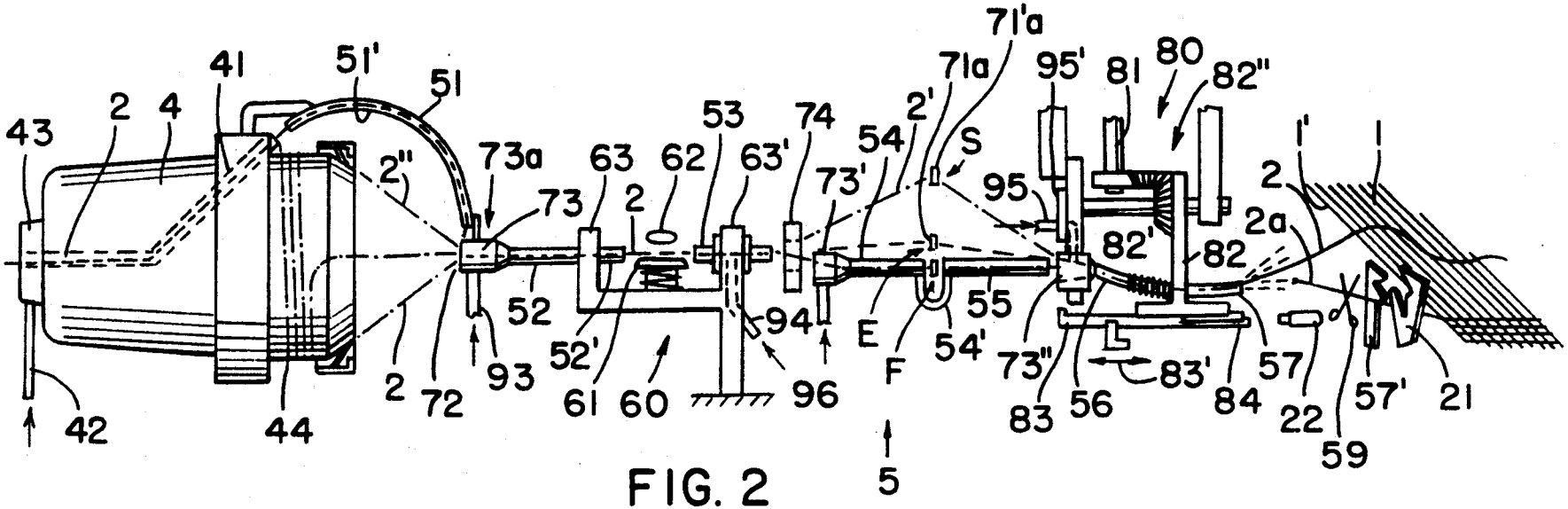
FIG. 2 is a diagrammatic view of the situation in FIGS. 1 and 1*a*.
Figure 4:
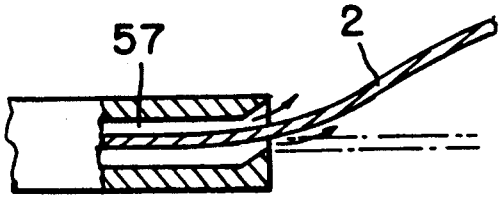
FIG. 4 shows the end of the guide duct before the entry into the shed of the loom.
Figure 3:
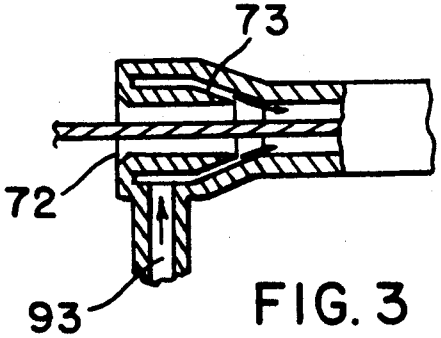
FIG. 3 shows a cross-sectional view of an injector nozzle.

Referring to FIG. 1, a weft yarn 2 is drawn off a bobbin 3 by means of one or more weft accumulators 4 and supplied through a yarn eye 72 to an injector nozzle 73 (see FIG. 2). Disposed between the nozzle 73 and the periphery of an accumulator 4 is a bent guide tube 51 formed with a slot 51' on the side near the accumulator. After going through a tubular member 52 disposed after the bent tube 51, the yarn is guided to near a yarn brake 60, the tube part 52' being slotted on its underside after a yarn-deflecting station 63 so that the yarn can issue downwardly from the slot 52' when a braking finger 62 presses the weft yarn downwardly on to a braking plate 61. In the continuation of its movement in FIG. 1*a*, the weft yarn 2 is injected through a weft yarn stop motion 74, also effective as yarn-deflecting station, into an injector nozzle 73' and a tubular member 54 disposed thereafter. The nozzle 73' and member 54 are both slotted at the top so that the weft yarn can form a yarn triangle 2'—2' as a result of a yarn tensioner 71*a* pivoting up into a position 71*e*. The weft yarn goes through another slotted tubular member 55 into an injector nozzle 73" and therefrom through a tubular member 56, the same connecting the nozzle 73" to a changer segment 82, into a tubular member 57. From the member 57, whose end part can be curved upwards as shown in FIG. 4, the weft yarn is blown freely over the warp yarns as shown in FIG. 2 or into an orifice 58 (FIG. 1*a*) in a yarn-guiding element 57' connected to a suction line. The particular weft yarn concerned can then be gripped by a gripper 84 of a yarn thrower 83. The segment 82 is part of a yarn changer 80 mounted in a casing 20. A shaft 65' for the yarn brake 60 and a shaft 75' for the yarn tensioner 71*a, b, c, d* are also mounted in the casing 20 like the changer shaft 82.

FIG. 2 diagrammatically illustrates the yarn movement together with the complete device. By means of an injector 43 at the entry of weft accumulator 4, the injector 43 having a compressed air connection 42, the weft yarn 2 is moved through a winder tube 41 into the winding zone of accumulator drum 44 whence the weft yarn 2 can be guided downwards through the bent guide tube 51 to the injector nozzle 73, to be intaken thereby when compressed air is supplied through a line 93. The weft yarn 2 then emerges from a slot 51' in a straight position 2"; upon issuing from the tube 51 the weft yarn is deflected from injector nozzle periphery 73a, because of the suction flow towards the yarn eye 72, back towards the accumulator 4. Further compressed air connections 94–96 are associated with further injector nozzles 63', which are also effective as yarn-deflecting stations, and with injector nozzles 73' and 73". The tubular members 54, 55 are interconnected by a retaining stirrup 54' and like the nozzle 73' are slotted at the top since the weft yarn is disposed in the tubular members 54, 55 only in the threading position F of the yarn tensioner, the weft yarn otherwise being disposed between the tensioning position S in a yarn eye 71'a of the yarn tensioner 71a or the untensioned position E. All four weft yarns are supplied before entry into the yarn changer 80 to a number of injector nozzles 73" which, depending upon the position of a changer shaft 82' and of a compressed air distributor 95' connected thereto, are supplied through a compressed air line 95. A pivoting movement is imparted to the yarn changer 80 through the agency of a changer drive 81 and gears 82". Four tubular members 56, to the same number as there are weft yarns, are disposed between the changer segment 82 with four throwers 83 and the injector nozzle 73' and perform some of the movement of the segment 82. The four throwers 83 are disposed in the segment 82 for movement in the direction indicated by a double arrow 83'. The throwers 83 retain the weft yarn front end by means of clamps 84. The weft yarn can then be transferred to a respective picking element 22 —a projectile in this case —which is guided by guide teeth 21 of a guide duct or tunnel in shed 1' to the other side of the loom. The yarn-guiding element 57' is effective so to position the weft yarn 2a after picking that such yarn can be re-engaged by the associated yarn clamp 84 and returned.

Figure 7:
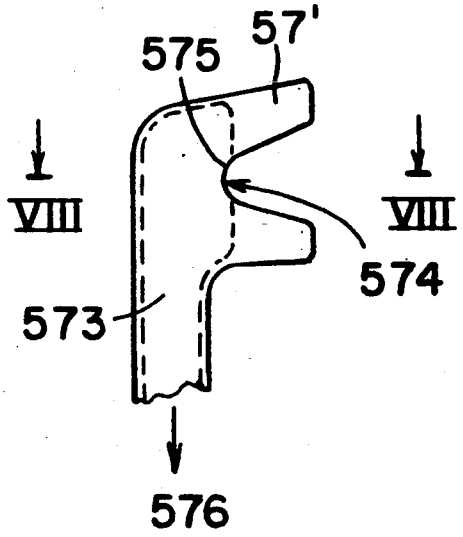
FIGS. 7 and 8 show an elevational view and a section of another embodiment of the yarn-guiding element.
Figure 8:
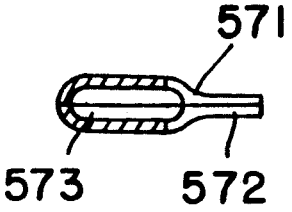

As shown in FIGS. 5 to 8, the element 57' has a hollow interior so that it can be connected to a suction line for the weft yarn 2 to be sucked through orifices 58, 575 respectively. The orifice 58 is disposed in a wide side of the element 57' and the orifice 575 is disposed in a recess 574 in the yarn-guiding element 57' which is combined from two halves 571, 572, as shown in FIGS. 7 and 8. The weft yarn is then severed at an appropriate place as it is being removed downwardly through the hollow interior 573 in the direction indicated by an arrow 576.

Figure 9:
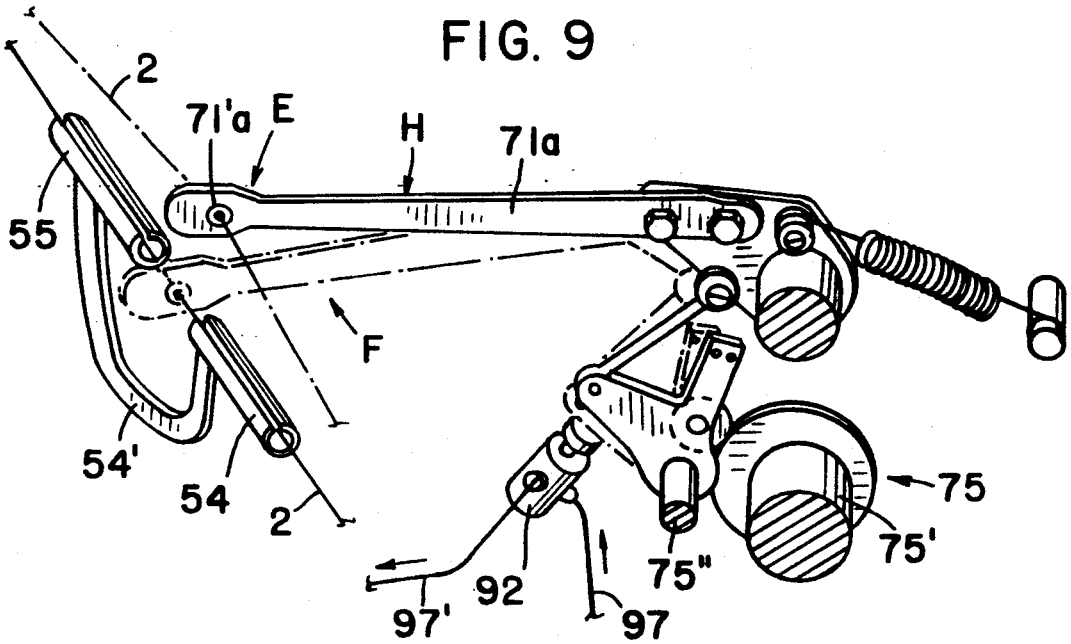
FIG. 9 is a perspective view showing the yarn tensioner and drive and the yarn guide near the yarn tensioner.

FIG. 9 is a perspective view of the yarn tensioner 71a and shows weft yarn movement near the tensioner 71a. The weft yarn 2 is blown into the complete device with the tensioner 71a in its chain-dotted-line position F. To this end, the yarn tensioner 71a is pressed down, for example, manually in the direction indicated by an arrow H in FIG. 9. A valve 92 disposed below a cam follower lever having a spindle 75" is actuated by way of linkage and allows compressed air to flow from line 97 into line 97'. When the tensioner 71a is depressed from position E into position F, the cam follower lever with shaft 75" disengages from the cam with shaft 75' of the drive 75 for pivoting the yarn tensioner 71a. When the yarn tensioner 71a is actuated and the valve 92 simultaneously opened, the effect of the compressed air entering through line 97' into a servo valve 91 in accordance with FIG. 1 is that compressed air can flow from a compressed air supply 9 through line 98 into all the injector nozzles 73, 73', 73" etc through the lines 93–98. The compressed air line 42 of the weft accumulator 4 is also supplied with compressed air at this time. The winder tube 41 must in this case have its exit orifice disposed opposite the entry orifice of the bent tube 51, something which can be achieved by means of an appropriate connection of the electrical drive for the tube 41. Also, the brake 60 must be in the open state. The weft yarn 2 can now be drawn by the injector 43 of the accumulator 4 to near the warp yarns 1. After the weft yarn 2 has been engaged by the yarn clamp 84 and transferred to the picking element 22, picking can proceed. After picking shears 59 sever the yarn 2. The device is particularly suitable for gripper looms, more particularly for projectile picking. Various elements of the device are also of use for nozzle looms.

Figure 10:
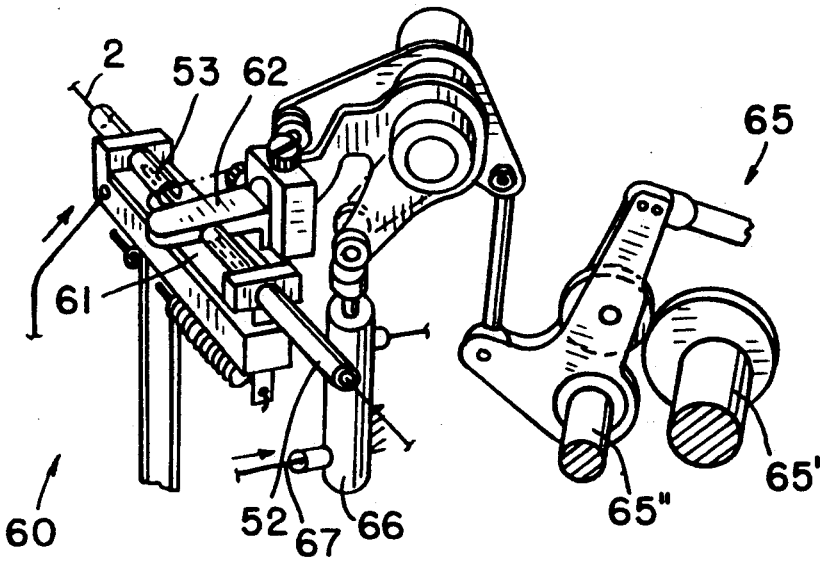
FIG. 10 is a similar view of the yarn brake.

FIG. 10 is a perspective detail view of the yarn brake 60. In normal weaving the brake 60 is alternately released and closed by a drive 65 having a shaft 65' with cam disc and a spindle 65" with a cam follower lever. To release the brake 60 an actuating cylinder 66 is supplied with compressed air through a line 67, which latter can also be connected to the servo valve 91.

Figure 11:
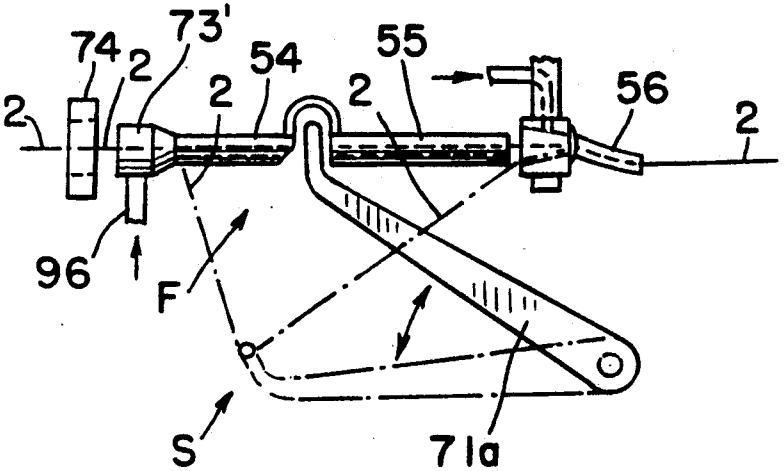
FIG. 11 shows a side view of another embodiment of the yarn tensioner.

FIG. 11 is a diagrammatic view of part of FIG. 2 showing a variant of the yarn tensioner and surrounding yarn guide, the axis of the yarn tensioner 71a being at a 90° offset from its position in FIG. 2. The yarn tensioner 71a threading position F and in chain-dotted line in the tensioning position S.

FIGS. 12a–12c show an embodiment for the yarn guide near the yarn tensioner 71a. Tubes 54, 55 are fashioned from a block B, a number of guide ducts being disposed one beside another in accordance with the number of weft colours. The tubes 54, 55 are open at the bottom and are interrupted by a recess A in which the annular yarn eye 71'a of tensioner 71a reciprocates vertically. In this embodiment the injector nozzles 73', 73" are integrated in the respective guide ducts. Compressed air is introduced from lines 95, 96 through a system of bores diagonally into the respective tube on both sides, the bores having a slight upwards inclination at their entry into the tubes at an acute angle to the conveying direction, a feature which can be gathered from FIG. 12c which is a section corresponding to FIG. 12a. In contrast to FIG. 11 the direction of weft yarn movement in FIGS. 12a–12c is from right to left.

After the circular plate formed with the injector orifices 73' in the changer segment 82 of FIG. 1a, further tubes in addition to and registering with the tubes 56 are provided to correspond to the number of injector nozzles 73".

Figure 5:
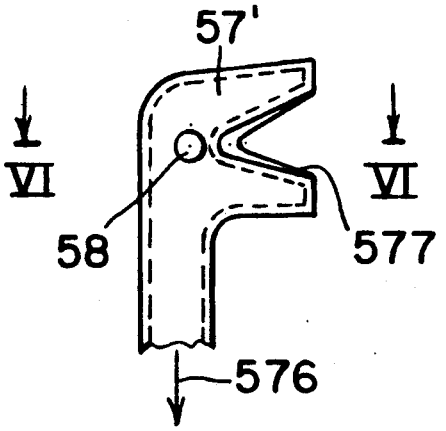
FIGS. 5 and 6 are a view in elevation and section respectively of a yarn-guiding element.
Figure 6:
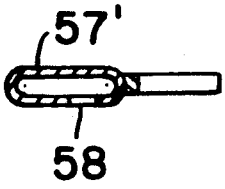

FIGS. 13a and 13b show a construction similar to the arrangement of FIG. 5 for catching the tip of the weft yarn 2. When the weft yarn 2 has issued from the tubular member 57 and moved freely past the yarn-guiding element 57', it is caught by a second yarn-guiding element 57" which is formed with a suction orifice 58". The element 57" is funnel-shaped and near the orifice 58" is widened plate-fashion transversely to the direction of flight of the weft yarn 2. Air is intaken through the orifice 58" by way of a suction tube 58'. After the weft yarn 2 has struck the inside of the orifice 58" it is deflected at right angles for a distance by the yarn-guiding element 57" and removed through the tube 58'; the weft yarn can, as shown in FIG. 13a, be deflected a number of times since the tube 58' has two elbows. Once a yarn stop motion 86 in the tube 58' detects the presence of the weft yarn 2, the drawing-in step can be considered to have terminated and the weft yarn is retained at an appropriate place, for example, at the brake 60. As a result of the yarn-guiding element 57"

being pivoted away by an actuating cylinder 87 to which compressed air lines 99 are connected and which acts on the element 57'' by way of a piston rod 88 and a lever 89, and because of the other yarn-guiding element 57' being pivoted, the weft yarn 2 moves, as shown in FIG. 13*b*, into the region of the element 57' below blade 570'. The weft yarn is therefore centred—i. e., accurately positioned—and can be engaged by the yarn clamp 84 which transfers the weft yarn to a picking element 22. After closure of the clamp 84, the shears 59 sever the weft yarn 2. The weft yarn piece disposed before the shears 59 on that side thereof near the reed 11 is then removed completely by the suction tube 58'. The weft yarn 2 can then be picked by the picking element 2 between the warp yarns 1 and beaten up by the reed 11 on to the cloth 10. The severed piece of weft yarn 2 goes through the tube 58' to a yarn collector 85. The yarn-guiding element 57'' could make a translational movement instead of a pivoting movement. The tube 58' can be made of a highly adhesive material, such as silicone rubber, so that the weft yarn 2, immediately on entry into the tube 58' and even after cessation of the suction air injected through line 99 into the injector 99', can stick to the inside of the tube 58' since the roughness of the yarn taken together with the stickiness of the inside of the tube 58' ensures that the yarn, which is pressed against the tube wall by its inherent elasticity, cannot slide away.

We claim:

1. A device for drawing a weft yarn into a loom, said device comprising at least one pair of tubular members disposed in coaxially spaced relation for guiding an air-entrained weft yarn therethrough, each said tubular member having a longitudinally extending slot to permit lateral deflection of a weft yarn from said respective member; and means for deflecting a weft yarn laterally from said tubular members.

2. A device as set forth in claim 1 wherein said means is a yarn brake having a braking plate spaced laterally of said tubular members and a braking finger for deflecting a weft yarn from said tubular members and being movable between a position spaced from said plate and a position engaging said plate.

3. A device as set forth in claim 1 wherein said means is a yarn tensioner movable between a position coaxially aligned with said tubular members and a position spaced laterally of said members to deflect a weft yarn from said members.

4. A device a set forth in claim 3 which further comprises a drive for pivoting said yarn tensioner between said positions.

5. A device as set forth in claim 4 wherein said yarn tensioner includes a yarn eye for passage of a weft yarn therethrough, said yarn eye being spaced between and from said tubular members in said coaxial positions thereof.

6. A device as set forth in claim 1 which further comprises a pair of yarn deflecting stations, each said station having a respective tubular member extending therefrom and being spaced apart for deflection of a weft yarn between said stations.

7. A device as set forth in claim 6 which further comprises means for supplying compressed air to each station for conveying a weft yarn therethrough.

8. A device as set forth in claim 1 which further comprises a yarn guiding element for catching a tip of a delivered weft yarn downstream of said tubular members relative to the direction of travel of the weft yarn.

9. A device as set forth in claim 8 wherein said yarn guiding element has a hollow interior for communicating with a suction source and an orifice for drawing a weft yarn tip into said hollow interior.

10. A device as set forth in claim 8 wherein said yarn guiding element is funnel-shaped and is pivotally mounted to pivot into the path of the weft yarn tip.

11. A device as set forth in claim 10 which further comprises a suction tube for drawing-in a weft yarn tip from said funnel-shaped yarn guiding element, said suction tube having an internal tube wall of yarn-adhering material.

12. A device as set forth in claim 8 wherein said yarn guiding element is pivotally mounted for moving a received weft yarn into a position for engagement with a yarn clamp.

13. A device as set forth in claim 1 which further comprises an injector nozzle disposed upstream of said tubular members relative to the direction of movement of said weft yarn for directing the weft yarn through said tubes.

14. A device as set forth in claim 1 which further comprises a yarn guiding duct downstream of and coaxially of said tubular members to receive a travelling weft yarn therefrom, said duct having an upwardly inclined outlet end to blow air above a shed of warp yarns.

15. A device as set forth in claim 1 which further comprises a block having two pairs of said pair of tubular members disposed in parallel therein.

16. A device as set forth in claim 15 which further comprises a pair of injector nozzles in said block, each nozzle being disposed in alignment with a respective pair of tubular members to direct a weft yarn therethrough.

17. A device as set forth in claim 16 wherein each nozzle is a bore within said block, each bore extending at an acute angle to the axis of said pair of tubular members.

* * * * *

UNITED STATES PATENT AND TRADEMARK OFFICE

CERTIFICATE OF CORRECTION

PATENT NO. : 5,144,987

DATED : September 8, 1992

INVENTOR(S) : Burer et al.

It is certified that error appears in the above-identified patent and that said Letters Patent is hereby corrected as shown below:

Column 2, line 1, change "shows" to --shows a cross-sectional view of--.

Signed and Sealed this

First Day of March, 1994

*Attest:*

*Attesting Officer*

BRUCE LEHMAN

*Commissioner of Patents and Trademarks*